US011466569B2

(12) United States Patent
Skulic

(10) Patent No.: US 11,466,569 B2
(45) Date of Patent: Oct. 11, 2022

(54) SYSTEM FOR THE REVERSIBLE TRANSFORMATION OF A RECIPROCATING MOTION IN A ROTARY MOTION

(71) Applicant: IBS MOTORTECH ITALIA SRL, Naples (IT)

(72) Inventor: Ivan Skulic, Tribulje (HR)

(73) Assignee: IBS MOTORTECH ITALIA SRL, Naples (IT)

( * ) Notice: Subject to any disclaimer, the term of this patent is extended or adjusted under 35 U.S.C. 154(b) by 247 days.

(21) Appl. No.: 16/468,110

(22) PCT Filed: Dec. 9, 2017

(86) PCT No.: PCT/IB2017/057765
§ 371 (c)(1),
(2) Date: Jun. 10, 2019

(87) PCT Pub. No.: WO2018/104923
PCT Pub. Date: Jun. 14, 2018

(65) Prior Publication Data

US 2020/0095865 A1 Mar. 26, 2020

(30) Foreign Application Priority Data

Dec. 9, 2016 (IT) ..... 102016000124647

(51) Int. Cl.
*F01B 1/06* (2006.01)
*F01B 9/06* (2006.01)
(Continued)

(52) U.S. Cl.
CPC ..... *F01B 1/0624* (2013.01); *F01B 9/06* (2013.01); *F01B 2009/061* (2013.01);
(Continued)

(58) Field of Classification Search
CPC combination set(s) only.
See application file for complete search history.

(56) References Cited

U.S. PATENT DOCUMENTS 1,087,240 A 2/1914 Kellington
1,282,824 A 10/1918 Hartson
(Continued)

FOREIGN PATENT DOCUMENTS

DE 653623 C 11/1937
DE 654870 C 12/1937
(Continued)

*Primary Examiner* — George C Jin
*Assistant Examiner* — Teuta B Holbrook
(74) *Attorney, Agent, or Firm* — Browdy and Neimark, PLLC

(57) ABSTRACT

The present invention provides a system for the reversible transformation of a reciprocating motion in a rotary motion, which comprises one or more actuating devices (11) adapted to cooperate on at least one interaction surface of a spiral profiled rotor (3), the system it is characterized in that each actuating device of said plurality of actuating devices (11) comprises hydraulic or internal combustion cylinders; the arrangement being such that each actuating device (11) urges a tubular slidable rod coupled to a respective cylinder, said tubular rod being associated with a slider (5), the slider (5) being adapted to transmit the thrust of said tubular rod (6) on said at least one interaction surface of the spiral profiled rotor (3) creating a torque on said rotor (3).

11 Claims, 14 Drawing Sheets

(51) Int. Cl.

| | |
|---|---|
| *F02B 57/08* | (2006.01) |
| *F02B 75/22* | (2006.01) |
| *F02B 75/26* | (2006.01) |
| *F02B 75/18* | (2006.01) |

(52) U.S. Cl.
CPC ..... *F02B 57/08* (2013.01); *F02B 75/222* (2013.01); *F02B 75/265* (2013.01); *F02B 2075/1864* (2013.01)

(56) References Cited

U.S. PATENT DOCUMENTS

| | | | | | |
|---|---|---|---|---|---|
| 1,456,479 | A * | 5/1923 | McKenzie | F01B 13/061 | 60/624 |
| 1,528,164 | A | 3/1925 | Nordwick | | |
| 1,597,474 | A * | 8/1926 | Nordwick | F01B 9/06 | 123/54.3 |
| 1,810,688 | A * | 6/1931 | Clark | F01B 9/06 | 123/55.3 |
| 1,996,710 | A * | 4/1935 | Sass | F04B 9/04 | 123/364 |
| 2,120,657 | A * | 6/1938 | Tucker | F02B 75/222 | 123/54.3 |
| 2,124,604 | A * | 7/1938 | Bidwell | F01B 9/06 | 123/53.5 |
| 2,174,664 | A | 10/1939 | Korany | | |
| 2,217,796 | A | 10/1940 | Dell | | |
| 2,249,951 | A | 7/1941 | Fulton | | |
| 2,450,912 | A * | 10/1948 | Putnam | F02B 75/246 | 92/74 |
| 2,496,040 | A * | 1/1950 | Criley | B21H 1/22 | 192/144 |
| 3,130,716 | A * | 4/1964 | Creswick | F02B 71/00 | 123/46 R |
| 3,396,633 | A * | 8/1968 | Ryzner | F03C 1/0531 | 91/230 |
| 3,510,143 | A * | 5/1970 | Carpenter | B60G 17/0525 | 280/6.159 |
| 3,688,751 | A | 9/1972 | Sahagian | | |
| 3,841,279 | A * | 10/1974 | Burns | F02B 57/00 | 123/43 C |
| 3,948,607 | A * | 4/1976 | Atwood | F04B 7/0053 | 422/63 |
| 4,899,853 | A | 2/1990 | Hummel | | |
| 5,232,666 | A * | 8/1993 | Longman | G01N 35/1016 | 141/130 |
| 5,634,441 | A | 6/1997 | Ragain | | |
| 5,673,658 | A * | 10/1997 | Allmendinger | F01L 9/10 | 123/90.12 |
| 6,449,940 | B2 * | 9/2002 | Nagel | F01B 9/06 | 123/197.1 |
| 7,942,115 | B2 * | 5/2011 | Skulic | F02B 75/265 | 123/54.3 |
| 10,408,201 | B2 * | 9/2019 | Smith | F04B 9/042 | |
| 2003/0024493 | A1 | 2/2003 | Beierle | | |
| 2007/0068468 | A1 | 3/2007 | Irick | | |
| 2014/0245981 | A1 * | 9/2014 | Schnell | F01M 9/106 | 123/90.48 |
| 2019/0032521 | A1 * | 1/2019 | Hirschmann | F01L 13/0036 | |
| 2019/0154016 | A1 * | 5/2019 | Ono | F04B 1/20 | |

FOREIGN PATENT DOCUMENTS

| | | | | |
|---|---|---|---|---|
| DE | 2413947 | A1 | 10/1974 | |
| DE | 4344545 | A1 | 6/1995 | |
| EP | 0318817 | A2 | 6/1989 | |
| FR | 2599084 | A1 * | 11/1987 | |
| GB | 457876 | | 12/1936 | |
| GB | 1334091 | A * | 10/1973 | F16D 71/00 |
| WO | 1996/16261 | A1 | 5/1996 | |
| WO | 2004/031576 | A1 | 4/2004 | |
| WO | 2006/057018 | A1 | 6/2006 | |

* cited by examiner

SYSTEM FOR THE REVERSIBLE TRANSFORMATION OF A RECIPROCATING MOTION IN A ROTARY MOTION

The present invention relates to a system for the reversible transformation of a reciprocating motion in a rotary motion and, more precisely, to a system for the reversible transformation of a reciprocating motion in a rotary motion which incorporates a spiral rotor.

STATE OF THE ART

An internal combustion engine is known from U.S. Pat. No. 7,942,115 which describes a system for converting a reciprocating rectilinear motion into a rotational motion. The system comprises an assembly of internal combustion cylinders, each of which has a rod which pushes a slider over the surface of a rotor. The rotor has a cross section with a spiral profile, and in such a way that the slider follows the surface and performs a compression and an expansion step. This solution of the prior art has proved satisfactory, although it has the disadvantage of that the thrust of the piston in the cylinder is based solely on the pressure of the combustion gas. This is a realization that decreases but does not solve the problems of environmental pollution, and is also relatively inefficient.

Consequently, there is a need to improve the operation of the internal combustion cylinder and spiral profile rotor system, in order to reduce the aforementioned problems of environmental pollution, and improve efficiency and, therefore, lower fuel consumption.

The present invention seeks to solve the abovementioned problems and drawbacks of the state of the art by providing a new energy supply system for the transformation of a reciprocating rectilinear motion in a rotational motion.

BRIEF DESCRIPTION OF THE INVENTION

Thus, the present invention provides a system for a reversible transformation of a reciprocating motion in a rotary motion which comprises one or more actuating cylinders and a rotor with a spiral section, each actuating cylinder of the plurality of actuating cylinders comprises a first and a second hydraulic cylinders internally assembled and independently slidable one with respect to the other, and wherein each hydraulic cylinder is coupled to a respective spring, the arrangement being such that the system provides for the rotation of the rotor each actuating cylinder uses separately a first spring of a first hydraulic cylinder and subsequently a second spring of said second hydraulic cylinder, for urging a tubular rod coupled to said first and second hydraulic cylinders, wherein said tubular rod at the opposite end thereof continuously contacts the surface profile of said spiral rotor and causing the rotation thereof.

According to the present invention, a system for operating a rotor with a spiral profile comprises one or more actuating devices, each of which comprises an arrangement with two independent hydraulic cylinders, each of which has a spring, a tubular rod, and a follower fitted with a wheel or the like. Each spring acts on the corresponding mobile member and slides inside the hydraulic cylinder wherein it is housed. The first sliding member of the hydraulic cylinder is operatively coupled to the first spring. The second sliding member of the hydraulic cylinder is operatively coupled to the second spring. The first spring moves the first sliding member according to a non-synchronous movement with respect to the second sliding member. A tubular rod is selectively coupled to the first sliding member and to the second sliding member alternately. The tubular rod transmits the thrust of the spring to the end of the slider-wheel. The end of the follower-wheel it is urged and slides outwardly of the cylinder due to the expansion of the first spring and, simultaneously, an hydraulic device external to the cylinder produces a hydraulic fluid pressure which it is transmitted to respective hydraulic cylinders, and causing the second spring to be compressed.

The arrangement is such that at each complete revolution of the rotor the said first and second springs alternate the expansion phase thereof: the first spring completes its expansion in a full revolution of the rotor, while the second spring by effect of the hydraulic pressure it is completely compressed in the same revolution period.

The present power device uses the force of the spring as the primary force for performing the useful work.

Thus, the present invention provides a system for a reversible transformation of a reciprocating motion in a rotary motion according to the appended claims.

The present invention has several advantageous aspects here below illustrated.

In a preferred non-limiting embodiment, the system uses two springs of different sizes but having substantially equal pushing force. Each spring acts on the respective sliding member and respective hydraulic cylinder to push the tubular rod which acts through the end of the follower-wheel.

By way of non-limiting example, the slider can be a wheel or, alternatively, also a low friction sliding surface (skid). The slider-wheel always contacts the surface of the spiral shaped rotor profile, thus transmitting the force from the device to the rotor surface transforming it into a driving torque.

It has to be pointed out here that the system of the present invention can use any power device known for conversion/transmission, such as: springs, hydraulic systems, pneumatic systems, electromagnetic systems, and combinations thereof, with the aim of creating the force necessary to compress the springs or to create the torque on the rotor shaft.

As a non-limiting example, the system comprises fixed parts and moving parts. The former include a body of each cylinder, a support plate, and a couple of hydraulic cylinders. On the other hand, the moving parts comprise two springs, a tubular push rod, a rotating or sliding follower mounted at the end of the rod, and two sliding members which slide one relative to the other and relative to the respective hydraulic cylinders, the sliding members being housed inside said cylinder body.

Furthermore, auxiliary parts external to the above illustrated system are provided, such as for example one or more hydraulic pumps and relevant hydraulic fluid regulator/distributor, and pump/pumps reservoir. These parts of the system will be specifically described hereinafter.

Preferably and according to the invention, a plurality of devices as described above can act on a single rotor member. The rotor can have a non-circular profile contact surface.

Thanks to the particular configuration of the spiral rotor, the thrust of each device it is transmitted on the rotor surface, causing the latter to rotate for a complete revolution in an expansion cycle of one of the springs.

The main feature of this system it is the ability to use the expansion phase of one of the springs to carry out useful work, i.e. the rotation of the rotor, while the second spring it is gradually compressed, and all this is achieved in a single rotation of the rotor. Therefore, the present invention utilizes a unique system for switching the actions between the springs: while one expands itself the other it is compressed. This function it is performed simultaneously, that is to say, while a spring is expanding the same produces a driving force onto the rotor giving a rotation force to the latter, and at the same time the other spring (which has expanded in the previous rotation period) it is in the compression phase. The compression of one of the two springs takes place by action of a hydraulic system (or any other similar system already known), and in such a way that the compressed spring will be completely ready to transmit the force to the rotor for the next following revolution of the rotor shaft. This cycle of switching between the springs is repeated for each revolution of the rotor.

The present invention provides noteworthy new solutions with important improvements compared to the most pertinent state of the art U.S. Pat. No. 7,942,115, wherein an application of a rotor with a polar spiral profile combined with an internal combustion thermal unit (cylinder-piston) it is already known.

Advantageously and according to a first inventive aspect of the present invention, in the case of use of the spiral rotor in combination with internal combustion cylinders (cylinder-piston), a circular section (or a constant diameter) surface of the spiral rotor it is provided, and in order to keep the piston in a stopped position at the T.D.C. top dead center (so-called "piston dwelling") and during the combustion phase, thus obtaining a complete combustion at a constant volume. The same configuration of piston stop it is obtainable at the bottom dead center B.D.C. and for the complete waste/washing/filling phase of the cylinder.

According to another advantageous aspect of the present invention, it is possible to make the surface of the rotor profile in different ways. As a matter of, according to the state of the art document U.S. Pat. No. 7,942,115, the contact surface with the cursor is always a flat surface on which the force generated by the cursor acts perpendicularly. According to the present invention the contact plane of the slider/follower it is inclined and in such a way that different angles of inclination of the slider/follower can be provided, obtaining a greater efficiency, and thus obtaining a number of possible constructive configurations.

According to a further advantageous aspect of the present invention, the cylinder expansion length it is expected to be decided by the constructor according to the project requirements.

According to another advantageous aspect of the present invention, it is possible to provide different embodiments of the system, wherein each of them has a determined arrangement of the actuating devices with respect to the rotor surface. More precisely, by varying the angle of inclination of the actuating devices with respect to the normal direction of the rotor surface it is possible to increase or decrease the value of the force exerted by the actuating devices on the spiral profile, and consequently increase or decrease the torque value of the rotor, while maintaining the cycle phases unchanged.

According to another advantageous aspect of the present invention, it is possible to manage the inclination of the actuating device(s) and, therefore, the direction of the force applied to the rotor, thus obtaining the possibility of varying the stroke of the urging member in a complete revolution of the rotor.

DETAILED DESCRIPTION OF THE INVENTION

A detailed description of some preferred embodiments of the system for the reversible transformation of a reciprocating motion in a rotary motion of the present invention will now be provided, given by way of non-limiting examples, and with reference to the accompanying drawings, wherein:

FIG. 1 is a schematic cross-sectional view of a first embodiment of an actuating cylinder according to the present invention, and wherein a first operating condition of the same it is shown;

FIG. 2 it is a schematic cross-sectional view of the cylinder of FIG. 1 in a second operating condition thereof;

FIG. 3 it is a schematic sectional view illustrating in part and in detail some components of the hydraulic supply system of the actuating device of FIGS. 1 and 2 according to the invention;

FIG. 4 it is a schematic and sectional view illustrating the system consisting of a plurality of actuating devices according to the preceding figures and associated with a rotor having a spiral profile according to the invention;

FIGS. 5A and 5B are schematic and cross-sectional views of two operating conditions of the system of the present invention and according to a second embodiment thereof, and wherein internal combustion cylinders are provided as actuating devices associated with a spiral profiled rotor;

FIG. 6 it is a schematic view of a third embodiment of the system of the present invention, wherein actuating devices acting both on the outer profile and on the inner profile of the spiral rotor;

FIG. 7 it is a schematic view of a fourth embodiment of the system of the present invention, wherein several actuating devices are provided and wherein the actuating devices act on non-planar planes contained on different profiles of the same spiral rotor;

FIG. 8 it is an enlarged schematic view of a part of the gear mechanism for controlling the compression of the spring according to the first embodiment of the present invention;

FIG. 9 it is a schematic view which partially illustrates the system of the present invention according to a fifth embodiment thereof;

Referring now to FIGS. 1, 2, 3, and 4 and it is evident the present system uses the force of springs as the primary driving force to perform the job.

The system provides a couple of different sized springs but having an equal thrust force arranged inside a single cylindrical block. Each spring acts on a movable member, housed within a respective hydraulic cylinder, and associated to a tubular rod which transmits the thrust to an end thereof coupled to a rolling slider (bearing). The rolling slider it is urged to maintain a continuous contact with the surface of the spiral rotor profile, creating a torque onto the rotor axis, and thereby causing the rotor to rotate. The hydraulic cylinders have different sizes but the same volumetric capacity.

An external system that supplies the power acts on the respective springs to compress them during each cycle. As non-limiting examples of external systems there are listed here below: a pneumatic system, a hydraulic system, an electromagnetic system.

Figure 1:
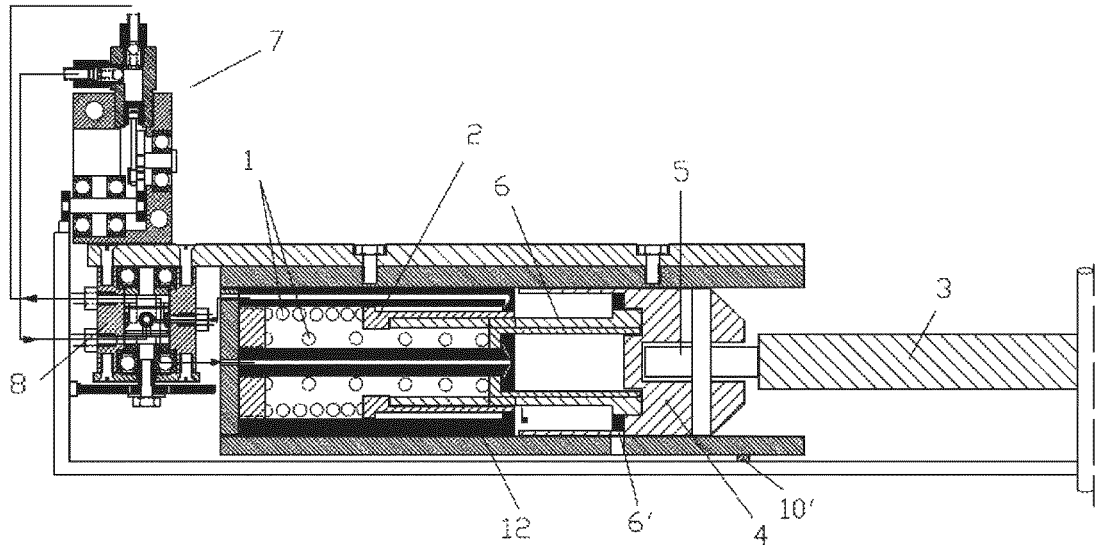
Figure 2:
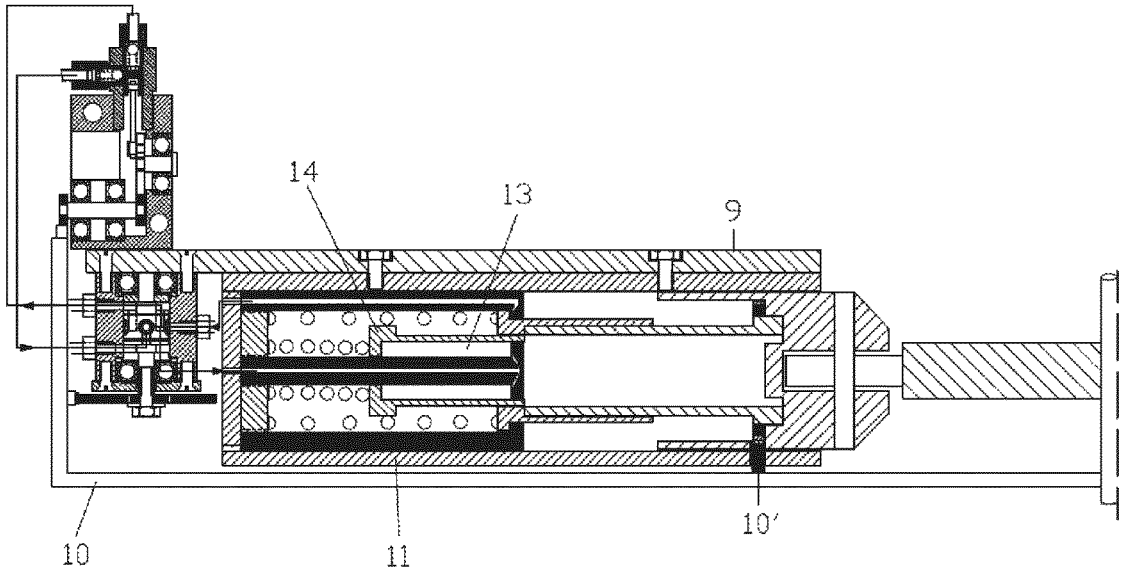

Referring now to FIGS. 1 and 2, the power/drive device comprises: a toothed disc (10) connected to the rotor shaft (3), a cylinder body (11), a support plate (9). A rolling slider (5) (roller or other low friction member on the surface) it is rotatably mounted onto a head (4), the head (4) it is slidably mounted on a tubular rod (6), the latter being also slidably mounted inside the cylinder body (11). The movable member (2) forms the inner part of the external hydraulic cylinder (12), while the external part of the actuating cylinder it is fixed. The movable member (14) constitutes the external part of the internal hydraulic cylinder (13), while the inner part of the cylinder it is fixed.

Both the movable members (2) and (14) of the hydraulic cylinders (12) and (13) are associated with the tubular rod (6) on one side, and on the other side they are associated to respective springs (1). The tubular push rod (6) it is always in contact with the supporting head (4) at one end thereof, while at the other end selectively engages the movable members of the cylinders (2) and (14).

As can be seen in the FIG. 2, the tubular push rod (6) carries a toothed ring (6'). A part of the toothed ring (6') faces outwardly of the cylindrical body (11) through an opening formed on the cylindrical body (11). The opening coincides with a toothed region (10') only when the disk (10) rotating brings the toothed region (10') at the opening on the cylindrical body and to achieve the coupling between the toothed region (10') with the toothed ring (6') of the rod (6). The engagement between the toothed region (10') and the ring (6') causes a rotation of the rod (6) by 90 angular degrees in its own seat. The rotation of the rod (6) about its own axis it is needed in order to selectively select the coupling of the rod (6) with the movable members of the hydraulic cylinders (2) and (14), the arrangement is such that for each rotation of the rotor the rod (6) rotates about its own axis and exchanges the engagement from a first movable member (2) and the second movable member (14).

Furthermore, it is provided that the rotation of the rod (6) is completed before the beginning of the retraction displacement of the rod (6) towards the inside of the cylinder (11), and by exchanging the engagement from the movable member (2) which has its own spring in the expanded condition with the other movable member (14) with the spring in compressed position. It is necessary to point out here that the toothed region (10') has a length such as to engage the ring gear (6') for a period such that the latter rotates of 90 angular degrees.

Figure 3:
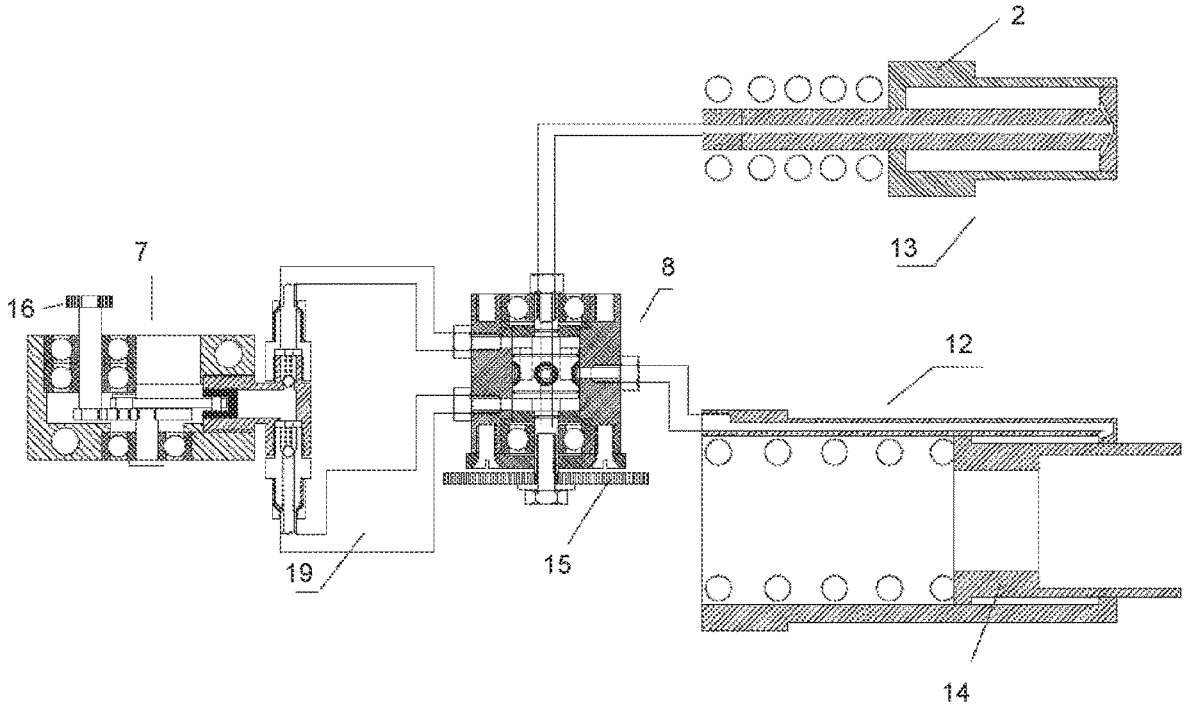

As illustrated in FIG. 3, an hydraulic pump (7) comprises non-return valves and it is connected to a hydraulic fluid distributor (8) through respective fluid outlet/inlet ports. The distributor (8) is also connected to the hydraulic cylinders (12) and (13) through the hydraulic fluid inlet/outlet ports. The pump (7) operates through the gear (16) mounted on the pump axis (7) which is in continuous contact with the toothed disc (10). The hydraulic cylinders (12 and 13) have channels for the fluid passage which are in connection with the distributor (8).

With reference to FIG. 3, the hydraulic distributor/regulator (8) comprises a gear (15) which controls the operation thereof. When the gear (15) rotates, it opens and closes the respective ports selectively to supply hydraulic fluid to the cylinders (12) and (13) on one side, while on the other side it ensures a return of the fluid to the tank (19) from the cylinders.

Figure 8:
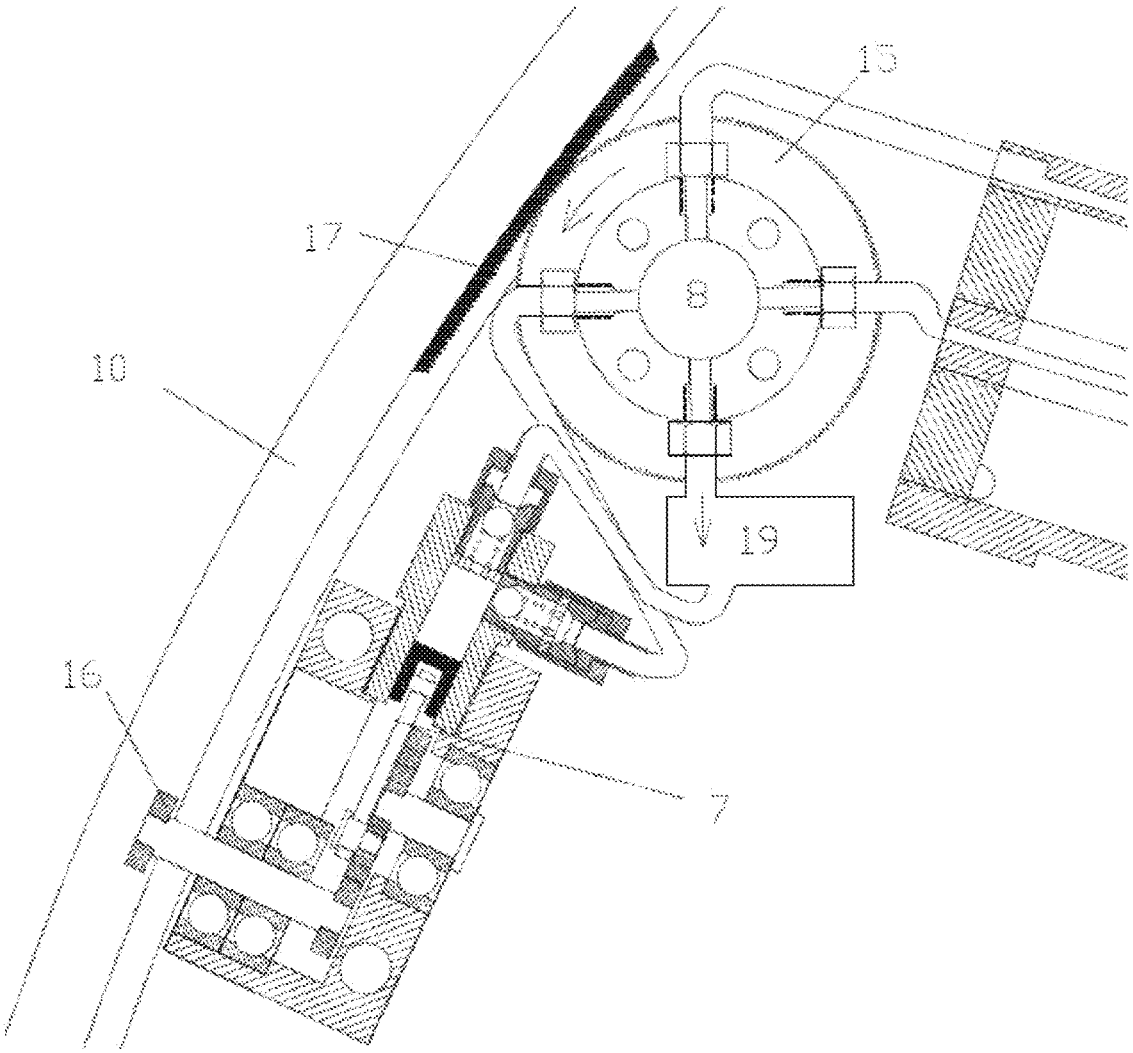

With reference now to FIG. 8, a toothed region (17) it is provided, and which extends along the inner surface of the disc (10), and it is adapted to engage with the gear (15) of the fluid distributor. The gear (15) rotates 90 degrees while it is coupled with the toothed region (17). The disk (10) it is connected to the rotor (3). It should be pointed out here that, if several power devices are provided, a respective toothed region (17) will correspond to each of them to control the operation of the relevant hydraulic distributor (8).

The toothed region (17) can be made integrally or connected with the disk (10). The disk (10) rotates with the rotor (3) which acts on the hydraulic fluid distributors (8) of the power devices, while the power devices and the accessories are fixed. The toothed region (17) has a length such that it engages the regulator gear (8) making the latter rotating of 90 angular degrees.

As can be seen from FIGS. 1 and 2, the first movable member (2) moves while biased by the respective spring, between a first position inside the outer cylinder (12) and a second position which extends beyond the cylinder (12), engaging with the tubular shaft (6) and pushing the rotor (3) through the slider holder head (4) and the slider (5) causing the former to rotate.

The tubular rod (6) has a notch in order to allow both the movable members (2) and (14) of the hydraulic cylinders (12) and (13) to slide in a uncoupled manner with respect to each other. The contact between the tubular rod (6) and the members (2) and (14) is obtained so that the tubular rod (6) rests on the base of the movable members.

As can be seen from FIGS. 1 and 2, the rod (6) is pushed into contact on the member (2), whose spring (1) is in the compressed position, while the member (14), after having finished its stroke under the pressure of the respective spring, is in a stationary position. At this point, the fluid regulator (8) changes the flow direction due to pressure from the pump (7), and then the fluid under pressure enters the cylinder (13) by acting on the mobile member (14). The member (14) moves under the pressure of the fluid, compressing the respective spring, while the member (2) is moving under the thrust of the expanding spring, and then pushing the tubular rod (6) and the relevant associated slider (5) on the rotor surface (3) causing the latter to rotate.

In the above described displacement of the movable members (2) and (14), the fluid it is expelled towards the tank (19) by the hydraulic cylinders (12) and (13) in each active stroke of the members (2) and (14), caused by pushing the springs (1).

Figure 4:
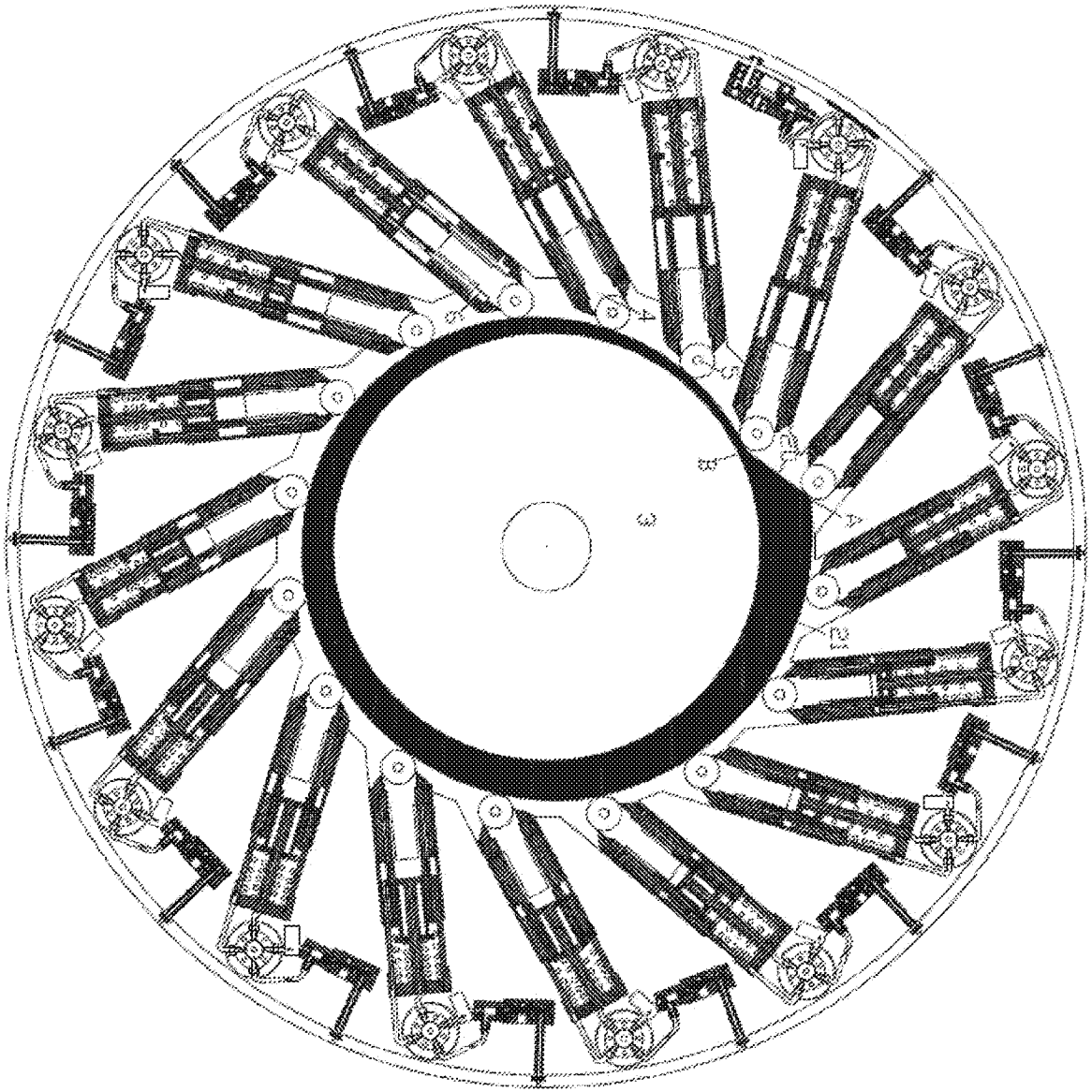

With reference now to FIG. 4, the rotor (3) has a curvilinear spiral profile. According to the present preferred but not limiting embodiment, the spiral rotor (3) has a curvilinear portion extending from a point "A" to a point "B" of the rotor profile (3) which, according to the present embodiment, is equivalent to a portion ranging from about 20 angular degrees to about 360 angular degrees of the rotor surface (3). Alternatively, and according to operational requirements, the curvilinear portion from point "A" to point "B" may extend for different lengths of the rotor surface (3). A non-curvilinear (or ramp) portion extends for the remainder of the circumference of the rotor from point "B" to point "A".

According to the embodiment shown in FIG. 4, in one exemplary and non-limiting embodiment, one or more actuating devices can operate on the spiral rotor (3) causing it to rotate in the direction of the arrow A. The sliders (5) maintain contact with the rotor profile (3) so that each respective actuating device acts on the rotor (3).

It should be noted here that each individual drive device can rotate the rotor (3). Due to the spiral configuration of the rotor (3), the force of each device is transmitted and converted to the rotor (3) in a driving torque causing it to rotate for a complete revolution at each active phase of the driving device.

At the end of the stroke of the tubular rod (6) the latter it is in a position of maximum extension from the cylindrical body (11) and coinciding with a complete revolution of the rotor (3) and via by the slider (5). In this position, the rod (6) is free of any resistance, and it is rotated about its axis by 90 angular degrees, thus detaching from the movable member (2) or (14) to which it is associated until that moment. In this condition, the rod (6) it is ready to engage the other moving member, which has so far compressed the respective spring under the pressure of the hydraulic fluid.

The re-entry displacement and the contacting with the member (2) or (14) has no resistance.

The re-entry of the rod (6) takes place through the rotor (3), which rotating acts with the return ramp (20) on the slider (5), thus pushing the group consisting of the slider (5), the head (4), and the tubular shaft (6) towards the inside of the cylindrical body (11).

As can be seen from FIG. 4 the rotor (3) has a curvilinear spiral surface (21) and it is arranged inside block housing power devices. The curvilinear profile of the rotor (3) it is always in contact with the slider (5). The rotor (3) has a non-curvilinear portion or ramp (20) which acts as a retracting ramp of the slider (5) in the cylindrical body (11).

When the rotor (3) rotates under the thrust of each of the actuating devices in the direction of the arrow (counter clockwise in the figure), at least one of the actuating devices engages the portion of the ramp (20). The rotor (3) acts by pushing the head (4) and the tubular rod (6) towards the inside of the cylindrical block (11) through the slider (5). The re-entry of the rod (6) and the head (4) is not impeded by any resistance, and the rod (6) it is brought into contact with the mobile member of the hydraulic cylinder to repeat the rotation cycle. For each cycle the compressed spring expands itself, and the slider (5) it is biased transmitting a torque to the rotor (3) along the curvilinear part (21). This interaction occurs for each actuating device which acts on the rotor (3).

FIGS. 1 to 3 illustrate the operation of an actuating device. The spring (1) it is compressed, and is in contact with the first movable member (2). The movable member (2) slides inside the cylindrical body (11) ensuring that the slider (5) maintains continuous contact with the rotor (3). The member (2) engages the rod (6), which through the head (4) and the slider (5) transmits the thrust to the rotor (3) on the curvilinear surface (21) as illustrated in FIG. 1.

As shown in FIG. 8, the gear (15) when actuated causes the fluid distributor (8) to rotate by an angular value of 90 degrees. For each drive by means of the gear (15), the distributor (8) exchanges the hydraulic fluid direction supplied by the pump (7) between the hydraulic cylinders (12) and (13).

While the fluid is pumped under pressure into a respective hydraulic cylinder, thereby effecting the compression of the respective spring, at the same time the fluid is ejected from the other cylinder due to the movement of the movable member which is moving under pressure of the respective spring. The mobile member under pressure of the spring is performing the useful work, i.e. the rotation of the rotor, while the other moving member is in the compression phase of the spring under fluid pressure.

According to this embodiment, a fluid, liquid, or gas is pumped through the distributor (8) through the appropriate passages connected with the hydraulic cylinders (12) and (13). This provides a hydraulic fluid pressure inside the hydraulic cylinder. Since the movable member is the only movable part of the cylinder, the same is moved under fluid pressure, effecting the compression of the respective spring.

As already pointed out, the active phase which makes the rotation of the rotor is carried out during the expansion of the spring. While the rotor (3) has a complete revolution, the spring expands and the thrust towards the rotor (3) is exhausted. During the spring distension phase, the hydraulic fluid contained in the cylinder is expelled from it towards the oil tank. The flow from the pump to the pump takes place through non-return valves.

It should be noted that in the various embodiments of the system of the present invention, the hydraulic fluid can be any fluid, liquid or gaseous. Moreover, the springs can be of various material and can be replaced by other equivalents, they can be compressed by the use of any liquid or gaseous fluid, or by the use of electromagnetic coils, as also any other known system can be used suitable for the purpose.

Figure 6:
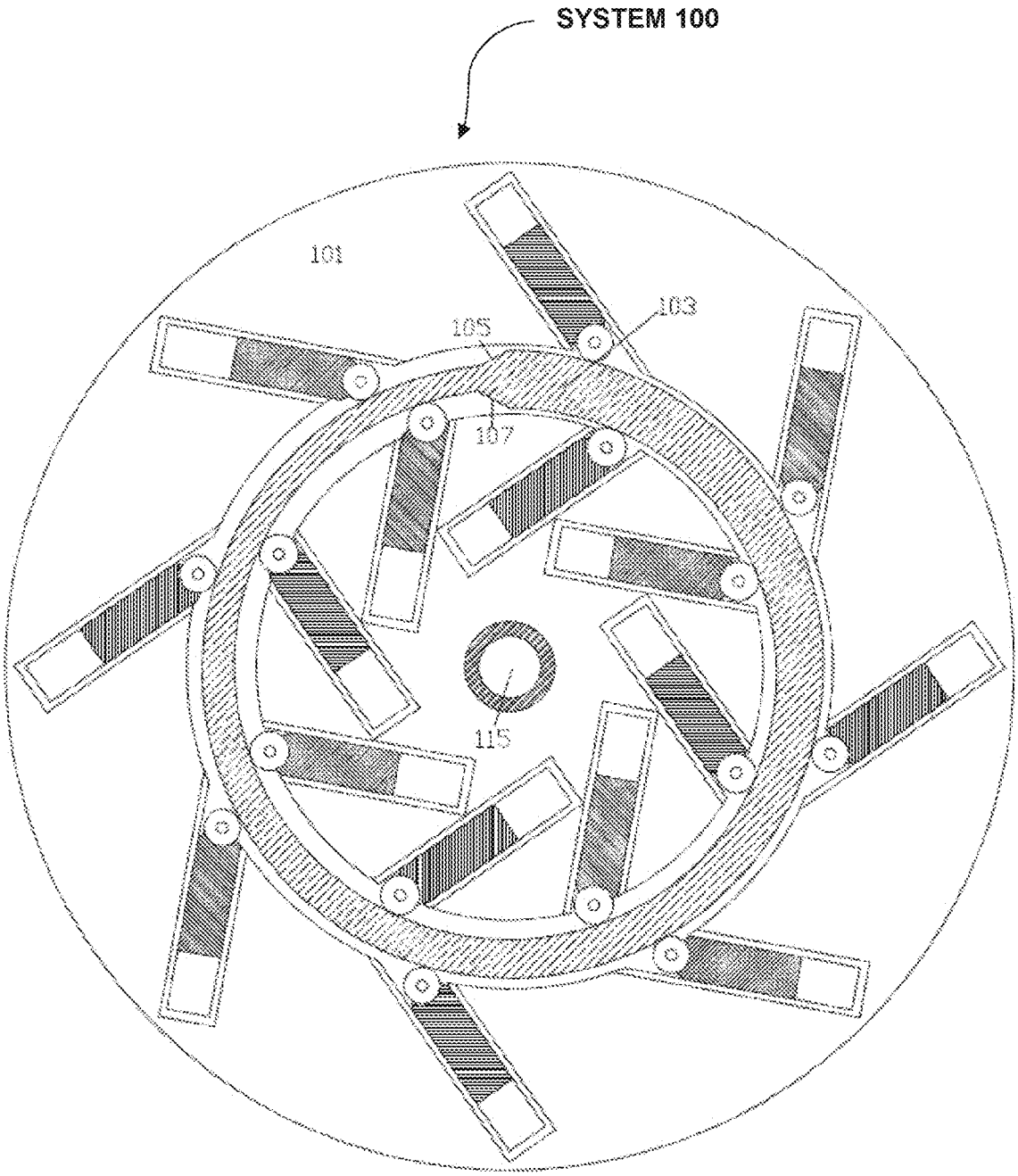

Referring now to FIG. 6, an alternative embodiment is illustrated wherein a rotary system consisting of different actuating devices it is provided. The main difference it is the use of an annular rotor with both internal and external profiles. A system 100 comprises a circular device plate (101). A rotor (103) it is arranged inside the center of the plate (101). The rotor (103) provides a first curvilinear external spiral profile with a retracting ramp (105) which connects the ends of the curvilinear profile. The rotor (103) also comprises a second spiral curvilinear profile internally connected to a retraction ramp (107). In this way, on both surfaces of the rotor (103), several actuating devices operate simultaneously.

It should be noted that each drive device of this system has a structure similar to that shown in FIG. 1.

It is the external group of devices that inside they are coplanar to the rotor (103). Each actuating device is arranged in the plate (101).

The forces of the respective devices are cumulative. In this way, more power can be supplied to a rotor of the same size with respect to the embodiment of FIGS. 1 to 4.

The number of devices that can be assembled on a rotor depends on its diameter and on the constructive choices. The more groups of devices are mounted on the internal and external profiles of the rotor (103), the more power will be transferred to the rotor. According to this embodiment, the actuating devices operate on the rotor (103) in the manner described above and with reference to FIGS. 1 to 5. Furthermore, a drive shaft (115) is arranged in the center of the rotor (103). The drive shaft (115) is coupled to the rotor (103) so as to rotate with it.

Figure 7:
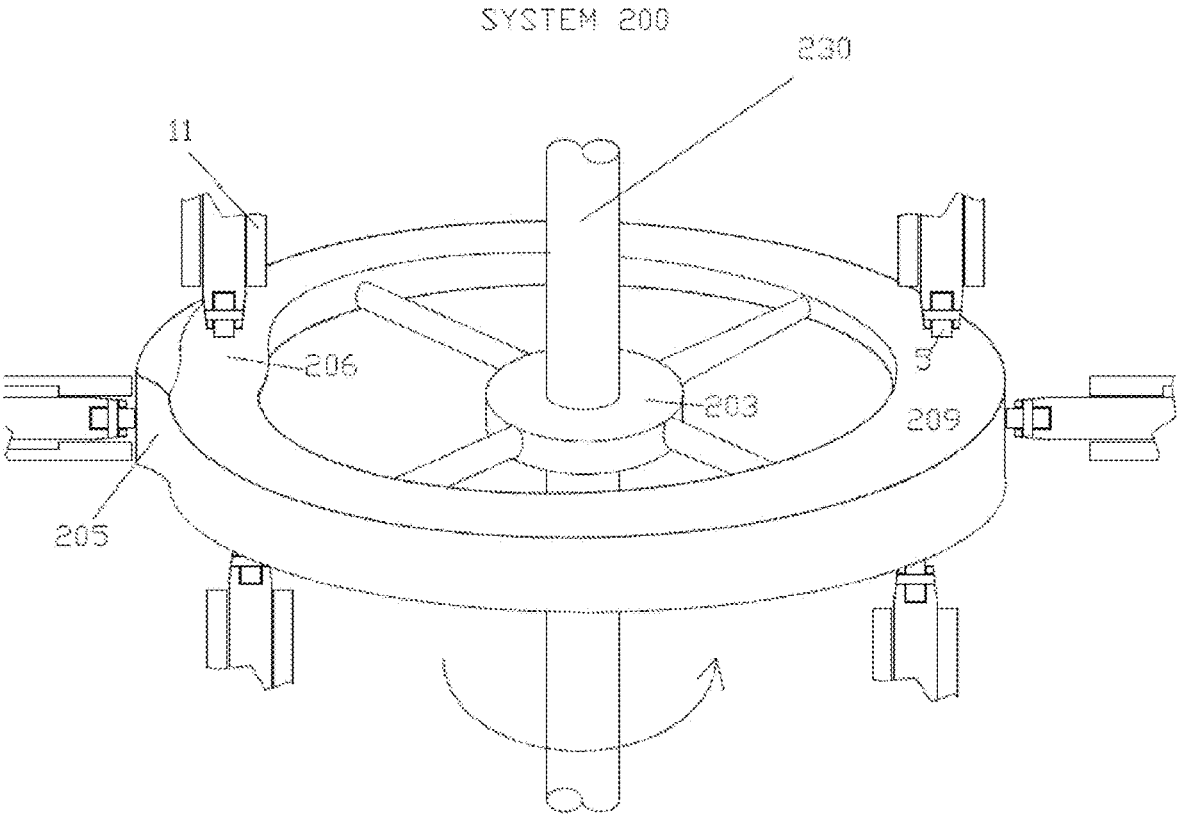

Referring now to FIG. 7 there is shown another embodiment of the system with a spiral rotor according to the invention.

In this configuration the system (200) provides a plurality of devices, some of which are not arranged on the same horizontal plane containing the rotor (203). The system (200) comprises a shaft (230) connected to the rotor (203).

The rotor (203) provides curvilinear profiles both on the horizontal (radial) surfaces and on the outer (tangential) surface containing each retraction ramp (205) and (206), respectively.

More precisely, a first ramp (205) is on an outer surface of the rotor (203). The rotor (203) has a curvilinear spiral profile. One or more actuating devices are arranged both on the horizontal and the vertical plane, to operate on the rotor (203) as said above. Each drive device has a structure as described in FIG. 1.

Some drive devices are positioned perpendicular to the rotor surface (203). The effective force of the devices positioned perpendicularly creates a rotation of the rotor (203) in the same direction (as indicated by the arrow) of those generated by the groups of devices arranged in different positions contained in the horizontal plane containing the rotor, and therefore these forces are cumulative with the forces applied to the rotor by the other devices mounted in different configurations.

Moreover, in a further alternative embodiment, three different surfaces of the rotor (203) can be engaged at the same time. The actual forces applied by all drive unit groups are combined to generate rotor rotation.

Figure 9:
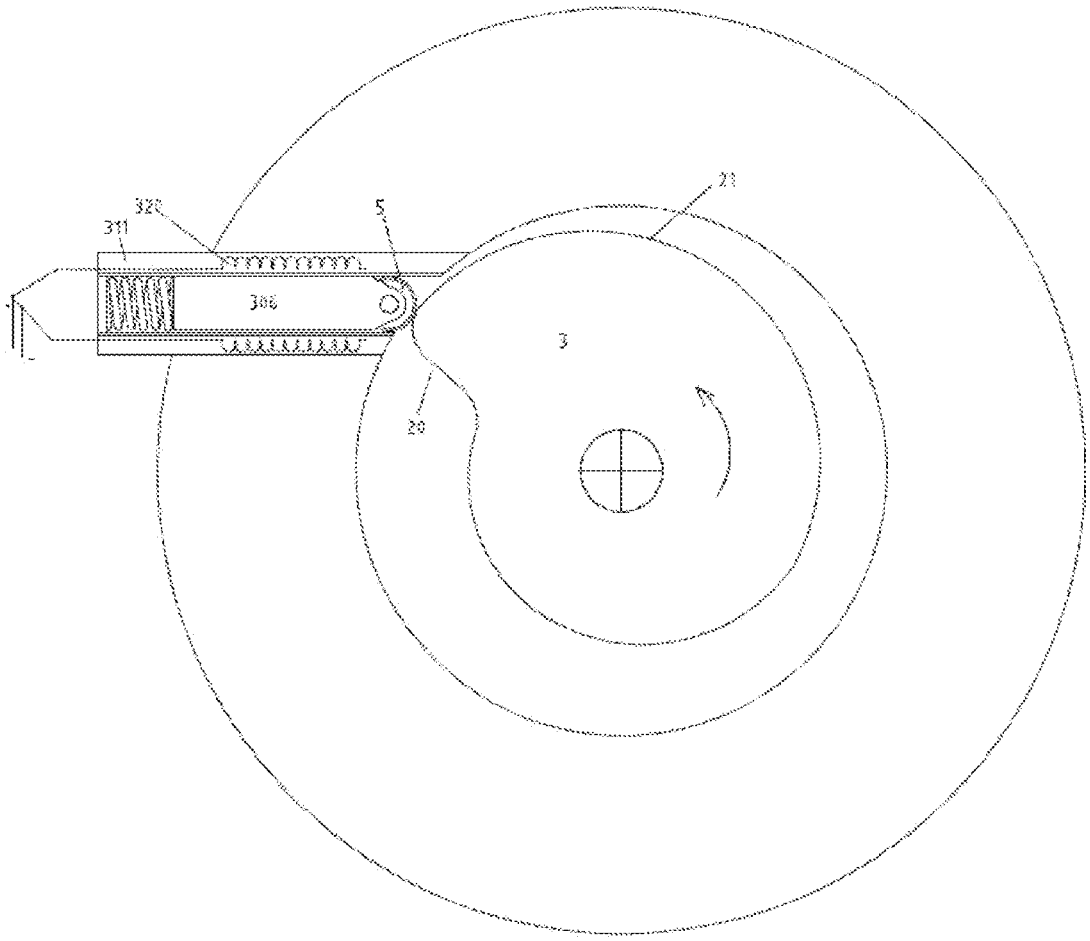

With reference now to FIG. 9, there is shown a further embodiment of the invention, wherein a system 300 is shown comprising a drive device which uses a single spring to provide the force necessary to push the push rod (306) to rotate the rotor with a curvilinear profile (3). The rotor (3) it is arranged within a cylindrical plate. The external profile (21) of the rotor engages a rolling cursor (5). Here, too, the rotor (3) has a non-curvilinear portion which acts as a retraction ramp (20).

The actuating device comprises a single spring. A push rod (306) is arranged inside the cylindrical block (311). The spring is arranged inside the cylindrical block between the base of the block and the push rod (306). The push rod (306) carries a slider (5) on the opposite end to that in contact with the spring. An electromagnetic coil (320) is predisposed to spring compression when it operates at a precise moment of the rotor revolution (3). The coil (320) is arranged in the cylindrical block (311). The rotor (3) acts on a switch (not shown) to cause current feeding to the magnetic coil (320) creating an electromagnetic force to compress the spring. The switch interrupts the electric current when the retraction ramp (20) has pushed the push rod (306) inside the cylindrical block, which happens without any resistance because the spring has been compressed by the magnetic force of the coil under current. Since the electric current is interrupted by the coil, the spring is released and pushes the push rod (306) out of the cylindrical block (311). Through the slider (5) the force is transmitted to the rotor (3) causing its rotation, as previously illustrated. The rotor (3) will interrupt the power supply to the electromagnetic coil (320), using the switch. The switch can be controlled by a microprocessor electronic control unit, or by mechanical activation according to the position assumed by the rotor (3) in the rotation.

Figure 5A:
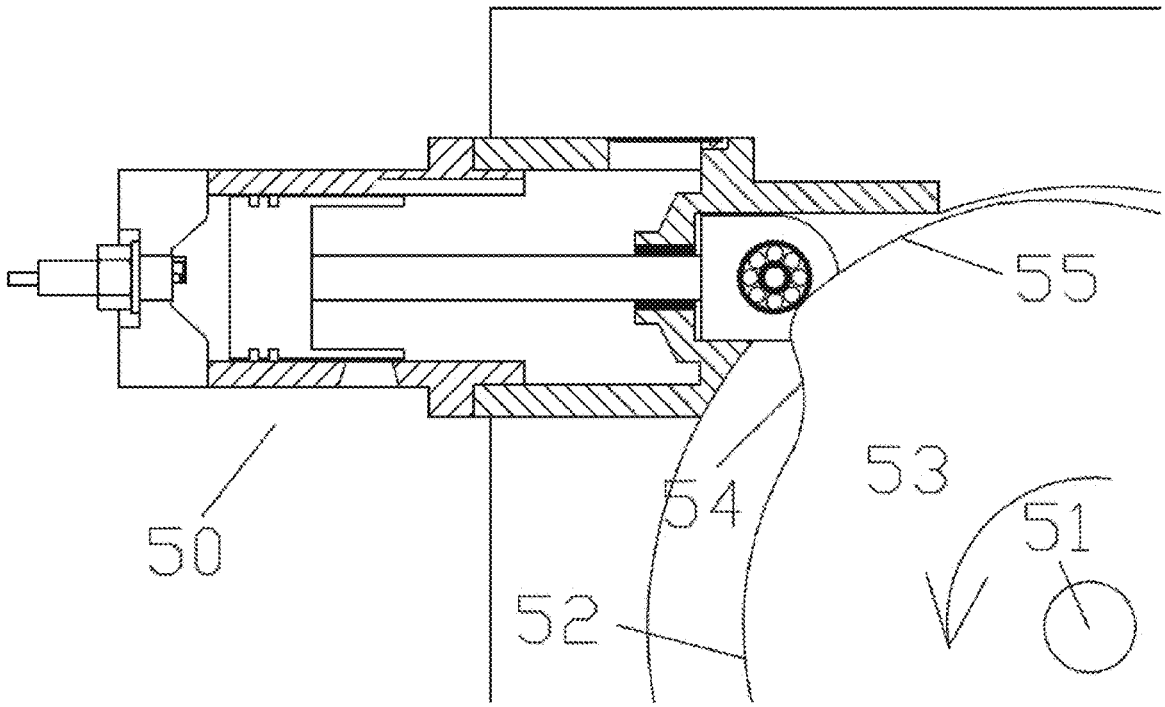
Figure 5B:
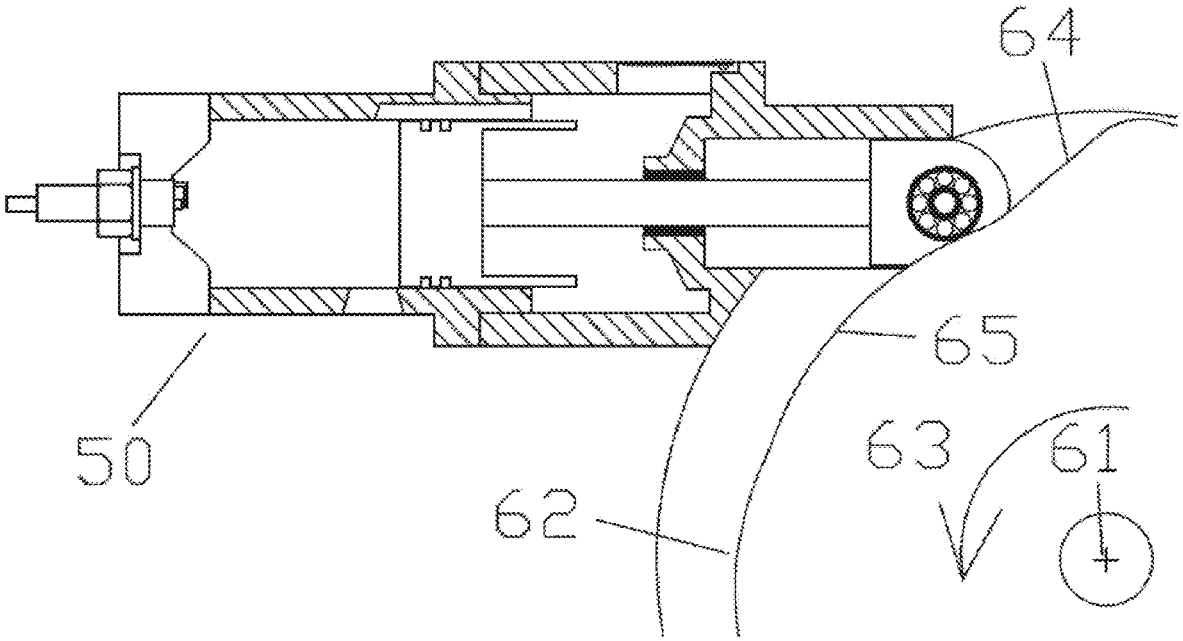

FIGS. 5A and 5B illustrate a further embodiment of the system of the present invention, where they are used one or more actuating members (50) of internal combustion endothermic type. The rotor (53) in FIG. 5A includes a constant diameter profile section (55) in order to keep the piston in a stopped position at the top dead center T.D.C. for the combustion phase, thus ensuring complete combustion at constant volume. The length of the section of constant diameter depends on the construction requirements that vary depending on the different types of fuel used and depending on the required thermodynamic values. The expansion of the cylinder is carried out on the portion (52) of the spiral profile of the rotor (53), to which the drive shaft (51) is coupled. The compression in the cylinder takes place in the portion of the rotor profile such as the retraction ramp (54), after which the constant volume combustion takes place for the duration of the piston stop period, followed by the expansion and repetition of the cycle.

Therefore, it is possible to simultaneously engaging, on the same rotor, groups of internal combustion cylinders fed with different fuels, arranged on the different profiles of the rotor according to the configuration of FIG. 7.

In FIG. 5B and presented the condition wherein the piston is kept in a stopped position at the bottom dead center B.D.C. for the complete waste/washing/filling phase of the cylinder. In this case, the rotor (63) is coupled to the drive shaft (61). The rotor (63) comprises a section of the constant diameter profile (65) extending from the exhaust valve opening position to the initial compression phase position. Compression is carried out via the ramp (64), while the expansion takes place on the section of the spiral profile (62) of the rotor (63). In this way the complete discharge of the burnt gases is assured.

Thanks to the configuration described above, a better washing of the cylinder (50) is obtained by expelling the burnt gas remaining in the cylinder and a complete filling of the cylinder with fresh air while the piston is not it moves and, therefore, does not interrupt the described cycle, unlike what happens in the current internal combustion engines.

Both the piston stop solutions to the T.D.C. and to the B.D.C they can be made on the same rotor. In this way, the characteristics and thermodynamic values of the cycles are considerably improved and more effective.

In each embodiment, the outer surface of the curvilinear profile of the rotor is in contact with the slider (5) along a coplanar or orthogonal direction. In other words, the cursor (5) transmits a force to the rotor with an angle of 0° (coplanar) or an angle of 90° (orthogonal) with respect to the plane of the rotor.

In the subsequent embodiments, the force applied to the rotor it is transmitted via slider (5) at a different angle from the rotor plane.

Figure 10:
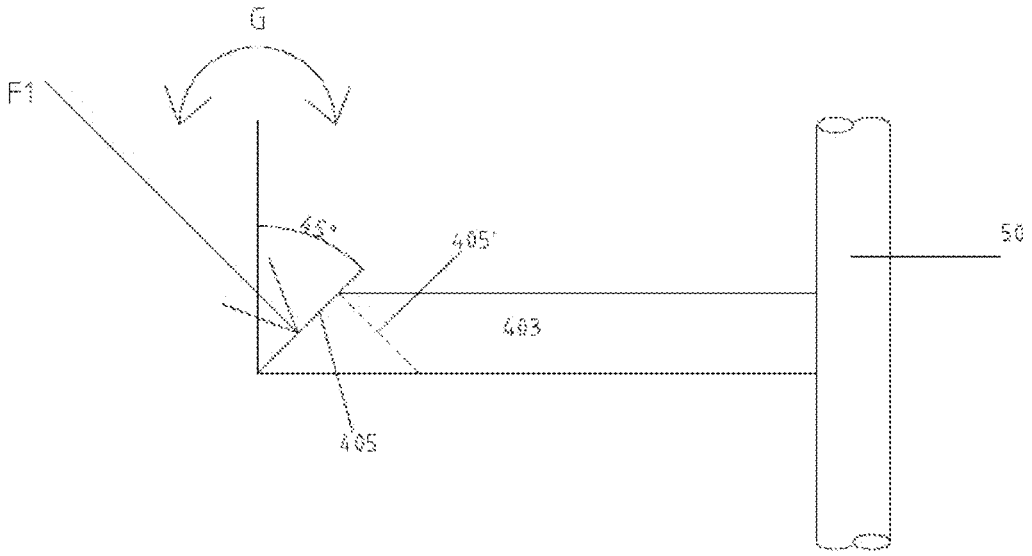
FIGS. 10 to 13 are schematic diagrammatic figures illustrating the force components applied to the rotor of the present invention and according to its different embodiments.

Referring now to FIG. 10, a system 400 includes a rotor (403) with a spiral profile, rotor (403) is coupled to a shaft (50). The outer surface of the rotor (403) has an outer surface (405) inclined by a predetermined angle (which can vary from about 1 to 89 degrees) with respect to the plane wherein the rotor (403) it is aligned.

In the system 400 a combination of actuating devices acts on the rotor (403) at the inclined surface (the devices not shown in the figure). The device assembly works with an inclination of 45 degrees relative to the rotor (403) and gives a greater net driving force to the rotor (403). The resulting force it is a force as shown by the F1 arrow. Changing the angle of inclination of the surface (405) of the rotor (403) the net force applied to the rotor (403) will change accordingly as a result of the variation of the angle because the transmitted force it is a vectoral function of direction.

While the angle of inclination can vary from 1 to 89 degrees with respect to the plane of the rotor (403), the relative orientation of the whole assembly of actuating devices can be modified in any position between about 1 and 179 degrees with respect to the plane of the rotor (403) or between −89 and +89 degrees with respect to the normal direction of the surface (405) as indicated by the double arrow G.

According to this system 400, the actuating devices can interact in a direction on the inclined surface (405) or in the opposite mirroring direction on the surface (405') of the rotor (403), as shown in dashed lines in FIG. 10.

Figure 11:
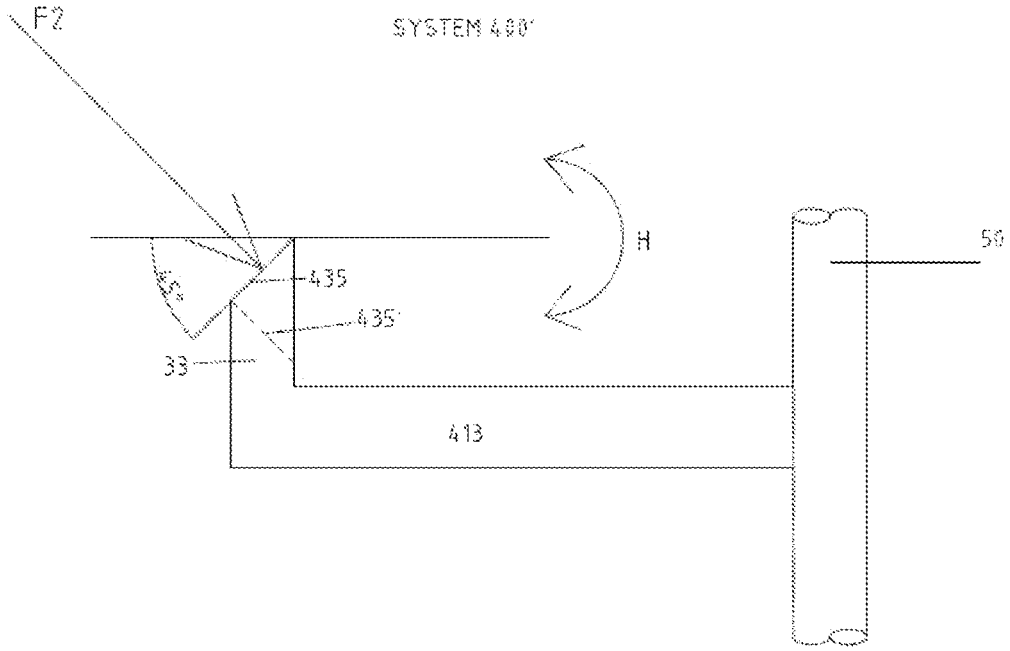

FIG. 11 shows a system 400' similar to the previous one wherein the profile (33) extends from the plane of a rotor (413) as described above. In this embodiment, a contact surface (435) of the rotor profile (33) of the rotor (413) it is inclined with respect to the profile orientation plane (33). Also in this case, the angle of inclination of the surface (435) can vary between 1 to 89 degrees with respect to the plane of the rotor (413).

In the present embodiment, if the drive unit assembly is positioned orthogonal to the profile (33), in this case, the resulting force is applied with an angle indicated by the arrow F2. In this case, the angle of the profile surface (33) can alternatively vary from about 1 to 89 degrees with respect to the plane and as shown by the dashed surface (435'). Furthermore, the orientation of the device assembly (400) can be comprised at any angle along the double arrow H to provide a variety of different driving forces at different angles, i.e. at any angle corresponding to from about 0 to 180 degrees relative to the plane of the rotor (413).

Figure 12:
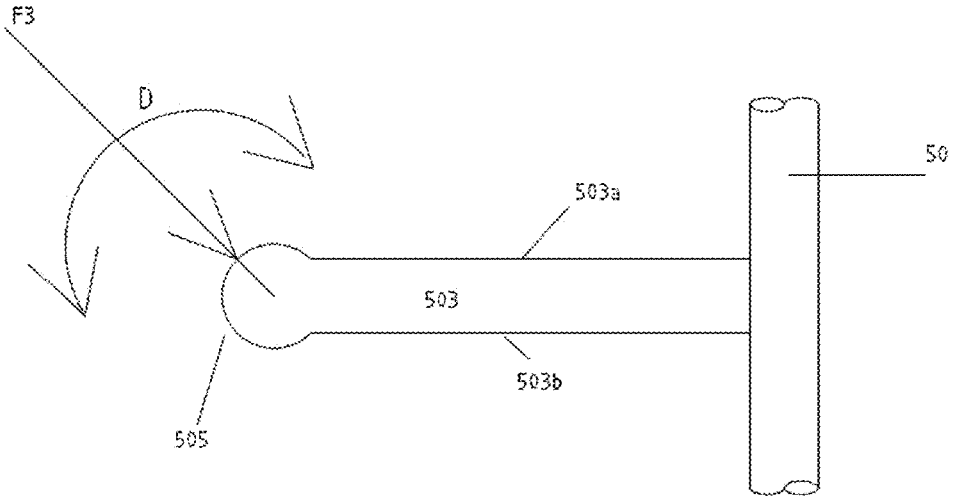

Referring now to FIG. 12 there is shown another embodiment of the rotor according to the invention. According to this embodiment there is provided a system 500 which comprises a spiral profiled rotor (503) comprising a spherical profile surface, i.e. convex surface (505). In this way, it is possible to provide a continuous and uninterrupted surface which allows a plurality of different angles of interaction with the respective actuating devices (not shown in the figure) and wherein the force can be applied as a function of the position of each actuating device.

The outer peripheral surface of the rotor (503) it is a rounded surface (505), and extends substantially 360 degrees from a first point of the surface (503*a*) of the rotor (503) to a second point of the surface (503*b*) of the rotor (503). The arc length of the rounded surface (505) depends on the thickness of the rotor (503).

The drive assembly can be arranged in a condition normal to the surface and in any position along the convex surface (505), in the direction indicated by the two-headed arrow D. By way of example, a force can be applied by an actuating device along a line as indicated by the arrow F3.

In this way, a greater net force can be applied by the group of actuating devices (not shown) by adjusting the angle of inclination of the group of devices relative to the plane wherein the rotor (503) resides.

Figure 13:
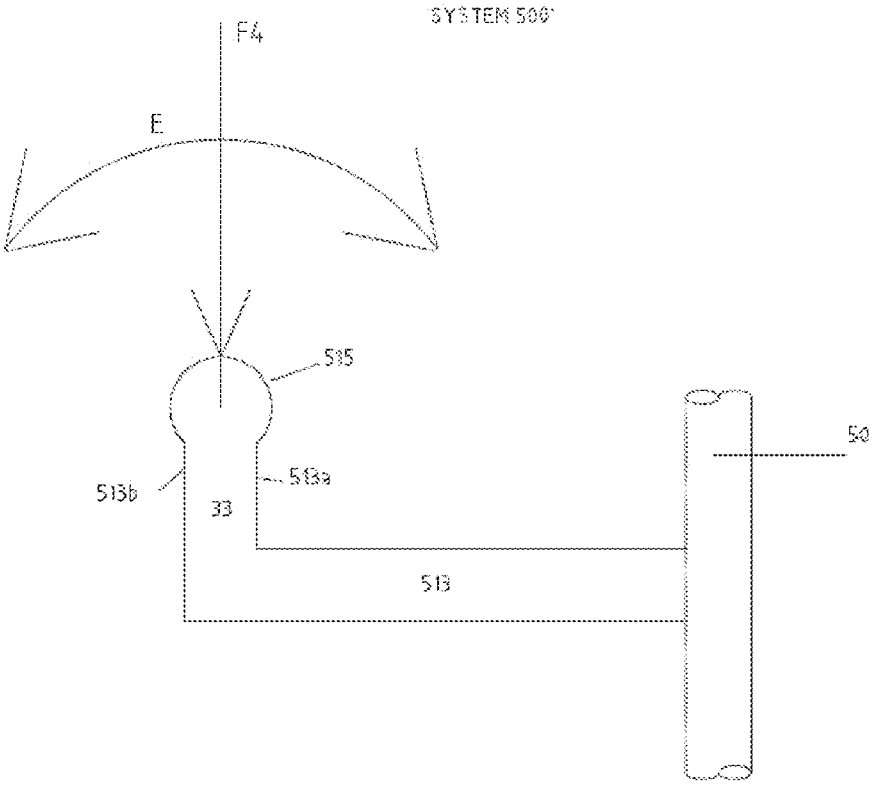

Referring now to FIG. 13 there is illustrated a further embodiment of the invention. According to this embodiment, a system 500 it is provided which comprises a rotor (513) substantially equal to the rotor (503) shown in FIG. 12, with the difference that the rotor (513) provides a surface containing the profile (33) and wherein the surface it is oriented along the vertical direction with respect to the plane of the rotor (513). The upper contact surface of the profile (33) has a circular shaped outer surface (515). The circular surface (515) extends from 1 to 360 degrees on the profile (33).

The assembly of actuating devices (not shown) can be oriented in relation to the circular surface of the rotor profile at any position along the surface (515), in the direction of the double arrow E, to have any inclination in relation to the circular surface (515), thus determining the direction of the force of the arrow F4.

Figure 14:
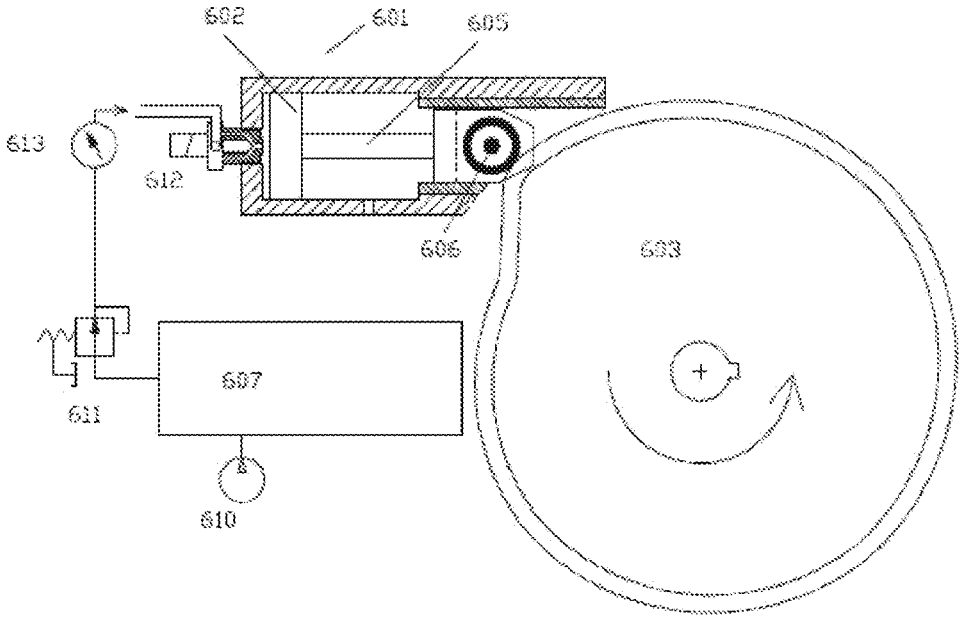
FIG. 14 represents a schematic view of a system comprising a compressed air drive device to operate the spiral rotor.

Referring now to FIG. 14, there is shown a further embodiment of the system of the present invention, wherein a system (600) it is provided comprising a rotor (603) substantially equal to the rotor (3) of FIGS. 1 and 2, an actuating device comprising a pneumatic cylinder (601) driven by compressed air, a pressure regulator (611), a pressure gauge (613), a reservoir compressed air (607), and an electromagnetic valve (612).

According to this embodiment, no spring there is provided to exert the driving force on the rotor (603), but the pneumatic cylinder (601) uses compressed air pressure to act on the piston (602). The piston rod (605) has a rolling slider (606) which acts on the rotor surface (603) causing the latter to rotate.

The compressed air it is injected into the pneumatic cylinder through the solenoid electromagnetic valve (612) which is opened only at a precise moment, i.e. when the piston (602) of the cylinder is at the top dead center T.D.C. (condition shown in the figure). The opening of the valve (612) it is regulated by an electronic control unit or by a simple device via contact managed by the rotation of the rotor (603).

After the injection of compressed air, the solenoid valve (612) it is closed until the rotor (603) makes a complete revolution. At the bottom dead center B.T.M. of the piston (602), the air it is released into the environment or partially recovered from the system.

Referring now to FIGS. 15A, 15B, 15C and 15D, the interaction between the rotor surface and an actuating device at the varying the inclination of the latter with respect to the normal direction of the rotor surface, and according to the system of the present invention.

As can be understood from the figures, by changing the inclination of the actuating device (706) with respect to the rotor surface (703) it is possible to obtain different values of forces and consequently different torque values onto the rotor (703).

Figure 15A:
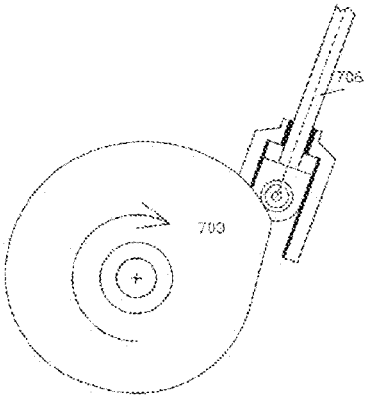
FIGS. 15A, 15B, 15C and 15D are views which schematically illustrate the interaction between the rotor surface and the actuating device as the inclination of the actuating device varies with respect to the normal direction of the rotor surface.
Figure 15B:
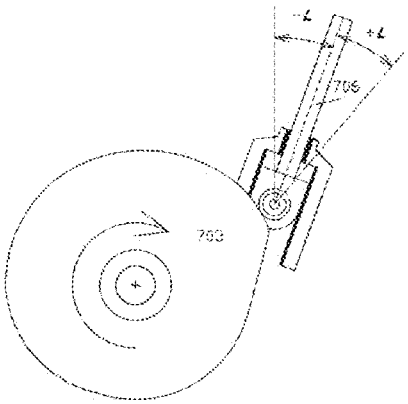
Figure 15C:
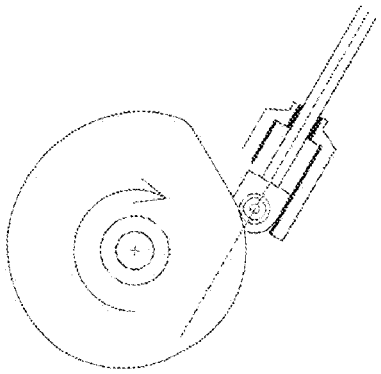
Figure 15D:
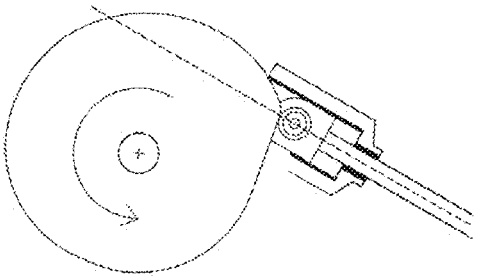

More precisely and with particular reference to FIGS. 15B and 15D, by changing the inclination of the actuating device (706) from (−L) to (+L), the lever arm acting on the rotor axis (703) is consequently changed, as well as the stroke of the actuating device, and also the rotation direction of the rotor (703), as shown in FIG. 15D.

It should be noted here that the cycle phases do not change, so that the expansion and compression phase of the device (706) are always connected to the spiral profile of the rotor (703).

According to this configuration it is possible to considerably increase the torque on the rotor axis (703) thanks to the choice of the degree of inclination of the device (706). Moreover, it is also possible to vary the run of the device (706) proportionally to the inclination of the same with respect to the surface of the rotor (703). In this way a longer or shorter stroke can be obtained, according to the constructive needs, but always corresponding to a complete rotation of the rotor (703).

Figure 16:
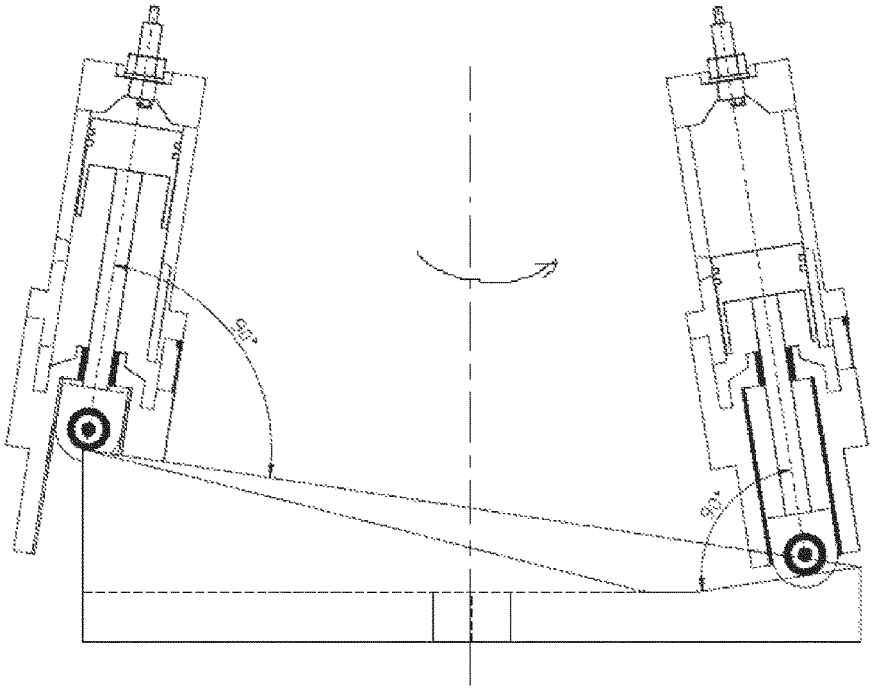
FIG. 16 illustrates a schematic view of a further embodiment of the system of the present invention.

Referring now to FIG. 16, there is shown a further embodiment of the system of the present invention.

According to this embodiment a new interaction solution there is provided between one or more piston cylinders and an interaction surface of a rotating rotor about its own longitudinal axis of rotation, wherein the rotor has a circular section, and the interaction surface of the rotor with said one or more piston cylinders it is normal to the longitudinal axis of the rotor and has a spiral profile with relevant elevation.

It should be pointed out here that according to further alternative embodiments, the rotor can have one or more interaction surfaces normal and/or parallel to the longitudinal axis of rotation.

According to the present embodiment, the positioning of the cylinder (s) provides that each cylinder it is arranged in a manner wherein the contact point of the rods of each cylinder with respect to the interaction surface of the rotor always has an angle of 90 degrees, i.e. orthogonal to the interaction surface.

This configuration guarantees an ideal distribution of forces on the surface of the rotor, where the same give maximum effect.

This configuration it is applicable both for internal combustion cylinders, or pneumatic or hydraulic cylinders or other equivalent solutions.

The force created by the assembly of the piston-cylinders is in this configuration always applied with a right angle throughout the active phase of the cycle, thus transmitting a better energetic effect with minimum energy losses involved.

Figure 17:
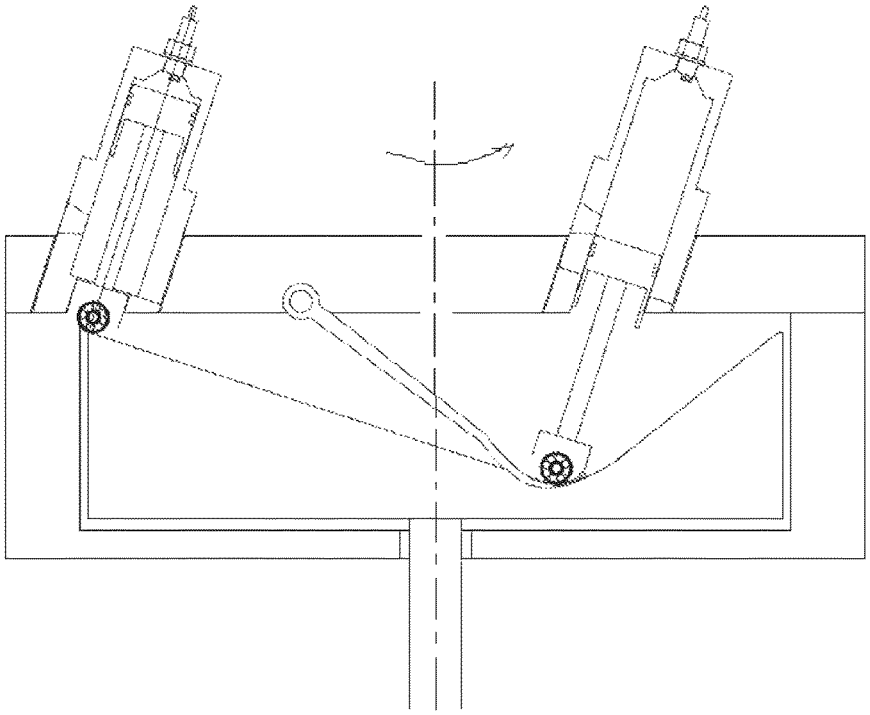
FIG. 17 shows a schematic view of another embodiment of the system of the present invention.

With reference now to FIG. 17 there is illustrated another embodiment of the system of the present invention.

According to this embodiment, an interaction surface of one or more cylinder-pistons of a rotor about a longitudinal axis it is provided, the rotor having a circular cross-section, and the interaction surface of the rotor with the said one or more piston cylinders it is normal to the longitudinal axis of the rotor, and the interaction surface has a spiral profile with a relevant lift ramp.

It should be noted here that according to alternative embodiments the rotor can have one or more interaction surfaces normal and/or parallel to the longitudinal axis of rotation of the rotor.

Further, a lever mechanism it is provided which acts during the piston stroke phase at the top dead center T.D.C. in the compression phase. That is, given that the portion of the rotor comprising the spiral profile has a lift ramp with excessive inclination and therefore creates excessive frictional forces during the stroke of the piston, the presence of the lever eliminates such problems during operation.

More precisely, the lever it is connected to the engine block and therefore does not rotate with the rotor. The lever has a fork shape and a relevant slider or follower placed at the fork end. The ramp acts on the slider, while the end of the lever interacts with the slider of the piston rod. While approaching the ramp, the lever rises and returns the piston to the top dead center T.D.C.

As soon as the top dead center of the piston T.D.C. is reached, the lever it is released and returns to the starting position. This solution, albeit simple, has the enormous usefulness of limiting the forces engaged, of generating little resistance to the displacement, and the friction is brought to a minimum.

This configuration is applicable for both internal combustion cylinders, or pneumatic cylinders, or hydraulic cylinders or other solutions equivalent.

It will be apparent to those skilled in the art that the present invention it is susceptible to other modifications in addition to what has been disclosed herein, without departing from the spirit of the present invention and all included in the scope of the appended claims.

The invention claimed is:

1. A system for a revisable transformation of a reciprocating motion into rotary motion, comprising one or more of actuating devices adopted to cooperate with a rotor having a spiral section and having at least one interaction surface for interacting with said one or more actuating devices;

wherein each actuating device of said one or more actuating devices comprises a pressurized fluid actuated cylinder and head, and wherein each actuating device is associated with a rod that incorporates a slider engaging with said at least one interaction surface of said rotor, wherein the slide rotatably mounted onto the head, and the head is slidably mounted on the rod;

wherein the one or more actuating devices are actuated by the pressurized fluid, wherein each hydraulic cylinder and head of a respective actuating device of said one or more actuating devices comprises a first and a second hydraulic cylinder coaxially assembled internally of said first hydraulic cylinder, each being independently slidable relative to one another, and wherein each of said first and second hydraulic cylinder is coupled to an elastic means; and, wherein each actuating device is configured to employ separately first elastic means of a first hydraulic cylinder and subsequently second elastic means of said second hydraulic cylinder to urge a tubular rod coupled to said first and second hydraulic cylinder, said tubular rod being associated with a head that incorporates the slider, said slider being adapted to transmit a thrust from said tubular rod to said at least one interaction surface of said spiral rotor creating thereby a torque onto said rotor.

2. The system for a reversible transformation of a reciprocating motion into a rotary motion according to claim 1, wherein said elastic means comprises springs.

3. The system for a reversible transformation of a reciprocating motion into a rotary motion according to claim 1, wherein said elastic means comprises a pressurized fluid.

4. The system for a reversible transformation of a reciprocating motion into a rotary motion according to claim 1, wherein each actuating device is arranged in an inclined condition with respect to the orthogonal direction of said at least one interaction surface of rotor.

5. The system for the reversible transformation of a reciprocating motion into a rotary motion according to claim 4, wherein the arrangement of each actuating device is such that by varying the inclination of said device with respect to the orthogonal direction of said at least one interaction surface of said rotor, the thrust value that said device applies onto said rotor is varied, and consequently a torque to the rotor is also varied.

6. The system for the reversible transformation of a reciprocating motion into rotary motion according to claim 1, wherein the arrangement of each actuating device is such that by varying the inclination of the device with respect to the orthogonal direction of said at least one interaction surface of said rotor, an expansion/compression stroke of each actuating device with respect to a complete revolution of said rotor is also varied.

7. The system for the reversible transformation of a reciprocating motion into rotary motion according to claim 1, wherein the arrangement of each actuating device is such that by varying the inclination of the device with respect to the orthogonal direction of said at least one interaction surface of said rotor, a direction of rotation of said rotor is changed.

8. The system for the reversible transformation of a reciprocating motion into rotary motion according to claim 1, wherein the at least one interaction surface is inclined with respect to the longitudinal axis of rotation of said rotor at a predetermined angle comprised between 1° and 89° degrees.

9. The system for the reversible transformation of a reciprocating motion into a rotary motion according to claim 1, wherein each actuating device is configured to be mounted at an inclined arrangement with respect to the orthogonal direction of said at least one interaction surface of said rotor by a determined angle which is comprised between −89° and +89° degrees.

10. The system for the reversible transformation of a reciprocating motion into rotary motion according to claim 1, wherein the at least one interaction surface has a convex surface.

11. The system for the reversible transformation of a reciprocating motion into a rotary motion according to claim 1, wherein the at least one interaction surface has a convex surface, and wherein each actuating device is configured to be mounted at an orthogonal orientation with respect to said convex surface.

* * * * *